US006470571B1

(12) United States Patent
Namiki

(10) Patent No.: US 6,470,571 B1
(45) Date of Patent: Oct. 29, 2002

(54) METHOD FOR PRODUCING A DECORATED ADJUSTER FOR A NECKLACE OR CHOKER

(75) Inventor: Hiromasa Namiki, Saitama-ken (JP)

(73) Assignee: Namiki Co., Ltd., Saitama-ken (JP)

( * ) Notice: Subject to any disclaimer, the term of this patent is extended or adjusted under 35 U.S.C. 154(b) by 0 days.

(21) Appl. No.: 09/504,026

(22) Filed: Feb. 29, 2000

(30) Foreign Application Priority Data

Mar. 2, 1999 (JP) ..... 11-099209

(51) Int. Cl.[7] ..... A44C 27/00

(52) U.S. Cl. ..... 29/896.41; 29/417; 29/516; 29/896.42; 72/416

(58) Field of Search ..... 29/896.41, 516, 29/417, 896.42; 72/71, 98, 118, 416

(56) References Cited

U.S. PATENT DOCUMENTS 2,434,008 A * 1/1948 Osborn ..... 29/516
3,284,882 A * 11/1966 Marchesan ..... 29/896.41
3,466,910 A * 9/1969 Carlsen ..... 72/71

FOREIGN PATENT DOCUMENTS

JP 63118817 8/1988
JP 3042071 10/1997
JP 3056705 12/1998
JP 11046826 2/1999
JP 3063739 8/1999
JP 2000-50920 2/2000

* cited by examiner

*Primary Examiner*—P. W. Echols
(74) *Attorney, Agent, or Firm*—Jordan and Hamburg LLP

(57) ABSTRACT

Method for producing a decorated adjuster for a necklace or choker in which a tube of elastic is inserted into a metal pipe to thereby form a raw material. The raw material is moved along a longitudinal axis while being rotated and pressed between a pair of molds having adjoining concavities formed between ends of the mold and in opposed relation to concavities in the other mold. The concavities have a shape gradually approaching a hemispherical form in a direction from an entry end to an exit end whereby the last concavity has a hemispherical form such that the raw material is progressively formed into a shell element. The shell elements have an inner surface coated with the elastic material and are formed upon the continual movement of the raw material through the molds. The shell elements are separated from one another and a pair of opposed through apertures are formed to thereby form the decorated adjuster.

26 Claims, 5 Drawing Sheets

(1ST STEP)

(2ND STEP)

(3RD STEP)

(4TH STEP)

METHOD FOR PRODUCING A DECORATED ADJUSTER FOR A NECKLACE OR CHOKER

FIELD OF THE INVENTION

The present invention relates to a decorated adjustor for necklace or choker, and a method for producing same. Particularly, the decorated adjustor is disposed between an ornament and setting rings of the necklace or choker, and has a hole through which a chain of the necklace or choker passes, when the decorated adjuster is mounted in the chain.

BACKGROUND OF THE INVENTION

The decorated adjustor for necklace or choker is arranged between an ornament in which a jewel such as a diamond, a pearl or etc. is mounted, and coupling rings for coupling one end of a chain with other end of the chain in the necklace or choker so that the necklace is made more pretty or the size of ring formed around a wearer's neck by the chain in the necklace or choker is adjusted, when a wearer wears the necklace or choker.

The present invention relates to a prior art, which is disclosed in Japanese Laid-Open patent Publication No. 2000-50920. FIGS. 6A–6D are schematic views illustrating a method for producing the conventional decorated adjustor for necklace or choker. The conventional decorated adjustor for necklace or choker will be described with reference to a drawing illustrated in a fourth step in FIG. 6D.

The decorated adjuster for necklace or choker comprises a sphere 11 which has a hollow 13 therein. The sphere 11 had apertures 14, 14 provided in face to face relation at the desired place for inserting and passing the chain 12 in the necklace or choker. The hollow 13 is filled with a silicon elastomer 15.

With the construction described above, the conventional decorated adjustor for necklace or choker is produced as follows.

Referring to FIG. 6A, in a first step, a pair of hemispheric elements 11*a* and 11*b* were joined to each other in a brazing or thermal deposition, whereby they were formed in a sphere 11. Apertures 14, 14 were then bored in a outer surface of the sphere 11 in face to face relation to one another.

In a second step (FIG. 6B), the sphere 11 was set in a mold 16 for drawing silicon rubber into a hollow 13 from the apertures 14, 14 thereof. At that time, the sphere 11 was heated to cause the silicon rubber to be crosslinked to the sphere 11. Thus, the sphere 11 was filled with silicon elastomer 15.

In a third step (FIG. 6C), a small hole was bored in the silicon elastomer from the holes 14, 14 by a a needle.

Finally, in a fourth step (FIG. 6D), a chain 12 was inserted and passed through the apertures 14, 14 and the small bore. Thus, a necklace or choker having the sphere 11, the decorated adjuster, was produced.

As described above, the conventional fashion in which the sphere 11 was produced by the brazed or thermally deposed hemispheric elements 11*a*, 11*b*, in which the silicon rubber was drawn into the hollow 13 of the sphere 11 set in the mold 16, and in which the small bore was bored through the silicon elastomer, had a problem of increase in difficulties in the production and the increased cost of production, depending on the small-sized decorated adjuster.

SUMMARY OF THE INVENTION

In order to solve the problems described above, an objective of the present invention is to provide a decorated adjuster for necklace or choker facilitating the production and allowing the decrease in cost of production, and a method for producing same.

In order to attain the above objective, the present invention provides a decorated adjustor for necklace or choker which is mounted at a desirable place of a chain in a necklace or choker, which is worn around and hung from a wearer's neck. The decorated adjuster 1 for necklace or choker comprises a shell element 1*c* made of precious metal, the shell element being hollow and having two apertures 1*a*, 1*b* having size slightly larger than that of a diameter of the chain in the necklace, the apertures being bored in a place of the shell element in face to face relation to each other, the shell element having an elastic element 1*d* coated over the inner surface thereof, as shown in FIGS. 1 and 5.

The elastic element 1*d* in the decorated adjuster for a necklace or choker may comprise silicon rubber.

The elastic element 1*d* in the decorated adjuster for a necklace or choker may comprise natural rubber.

The shell element 1*c* in the decorated adjuster for a necklace or choker may comprise sphere.

The shell element 1*c* in the decorated adjuster for a necklace or choker may comprise a mirror ball.

A first method for producing the decorated adjuster for a necklace or choker comprises the steps of producing a raw material 4, which comprises a metal pipe 2 and an elastic tube 3 fitted in the metal pipe 2; intermittently rotating the raw material 4 while intermittently moving the raw material 4 along an axis; intermittently pressing the raw material 4 with a pair of molds 5 each having a plurality of concave surfaces 51, 52, 53 and 54 such that an original form 1*c'* of the decorated adjustor for a necklace or choker will be progressively formed between a rear and a front ends in the moving or traveling direction, whereby a plurality of the shell elements 1*c* connected to one another are formed; and cutting the connected shell element 1*c*.

A second method for producing the decorated adjustor for a necklace or choker comprises the steps of producing a raw material 4 comprising a metal pipe 2 and an elastic tube 3 fitted in the metal pipe 2; intermittently moving the raw material 4 along an axis; intermittently pressing the raw material 4 with a pair of molds 5 each having a plurality of concave spherical surfaces 51', 52', 53' and 54" which are formed in the approximately same shape as a profile of the decorated adjustor, such that a plurality of the shell element 1*c* connected to one another are formed; and cutting the connected shell element 1.

DETAILED DESCRIPTION OF THE INVENTION

Figure 1:
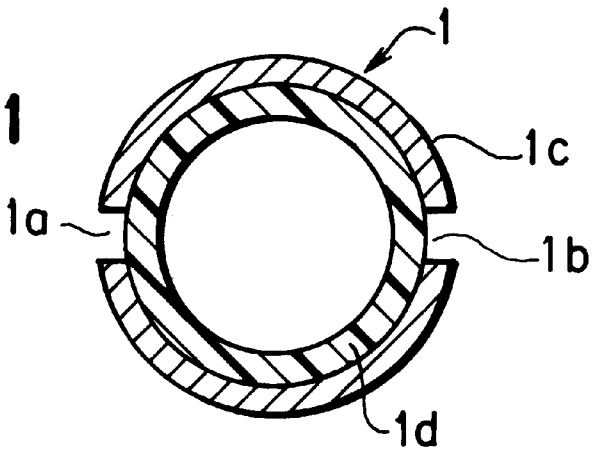
FIG. 1 is a cross-sectional view illustrating a decorated adjuster for a necklace or choker, according to the present invention.

A decorated adjuster for necklace or choker in accordance with embodiments of the present invention is shown in FIG. 1. A decorated adjuster 1 for necklace or choker is placed at a place in a decorated chain worn by a wearer and hanging from a neck of the wearer. The decorated adjuster for necklace 1 has a shell element 1*c*. The shell element 1*c* has two aperture 1*a*, 1*b* bored in the surface of the shell element 1*c* in face to face relation to one another for inserting and passing the decorated chain through an interior of the shell element 1*c*. Each of the apertures 1*a*, 1*b* formed in the shell element 1*c* has a diameter slightly larger than that of the decorated chain passing therethrough. The shell element 1*c* comprises precious metal such as gold, silver and platinum, and has an elastic element 1*d* covered over an inner surface thereof. Thus, the shell element 1*c* is hollow.

The elastic element 1*d* comprises a material such as silicon rubber, natural rubber, and soft plastic.

The shell element 1*c* made of the precious metal may be formed in a sphere shape, as shown in FIG. 1, or may comprise a mirror ball (not shown).

The description will now be made in detail of two processes for producing the decorated adjuster for a necklace or choker.

The first process for producing the decorated adjuster will be described with reference to FIGS. 2 and 3.

Figure 2:
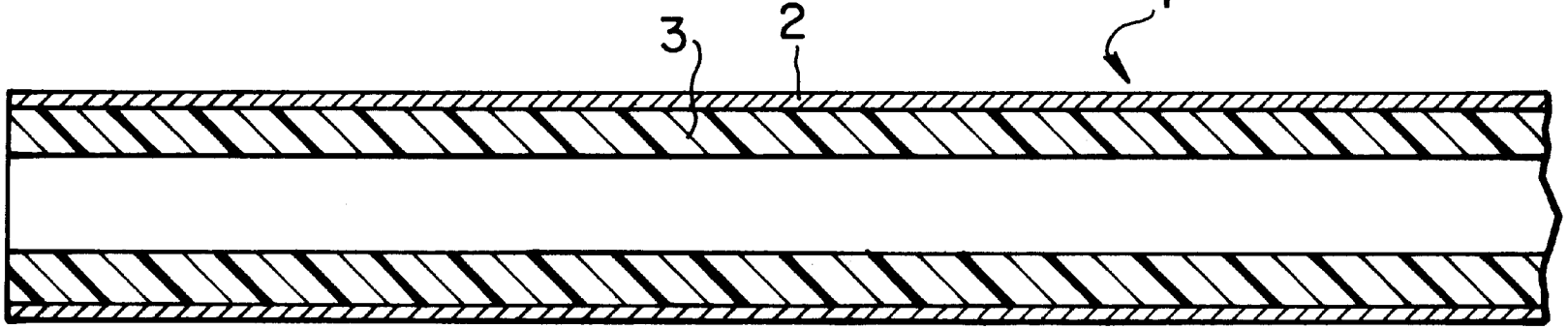
FIG. 2 is a cross-sectional view illustrating a raw material used with a production of the decorated adjuster for a necklace or choker, according to the present invention.

Referring with FIG. 2, in a first step, an elastic tube 3 made of a material such as silicon, natural rubber, and soft plastic is fit into a metal pipe 2 made of precious metal such as metal, silver, and platinum. The metal pipe 2 is molded of metal plate in a rolling up process. When the elastic tube 3 is mounted in the metal pipe 2, clearances from the elastic tube 3 to the metal pipe 2 are maintained. Thus, a raw material 4 is produced.

Figure 3:
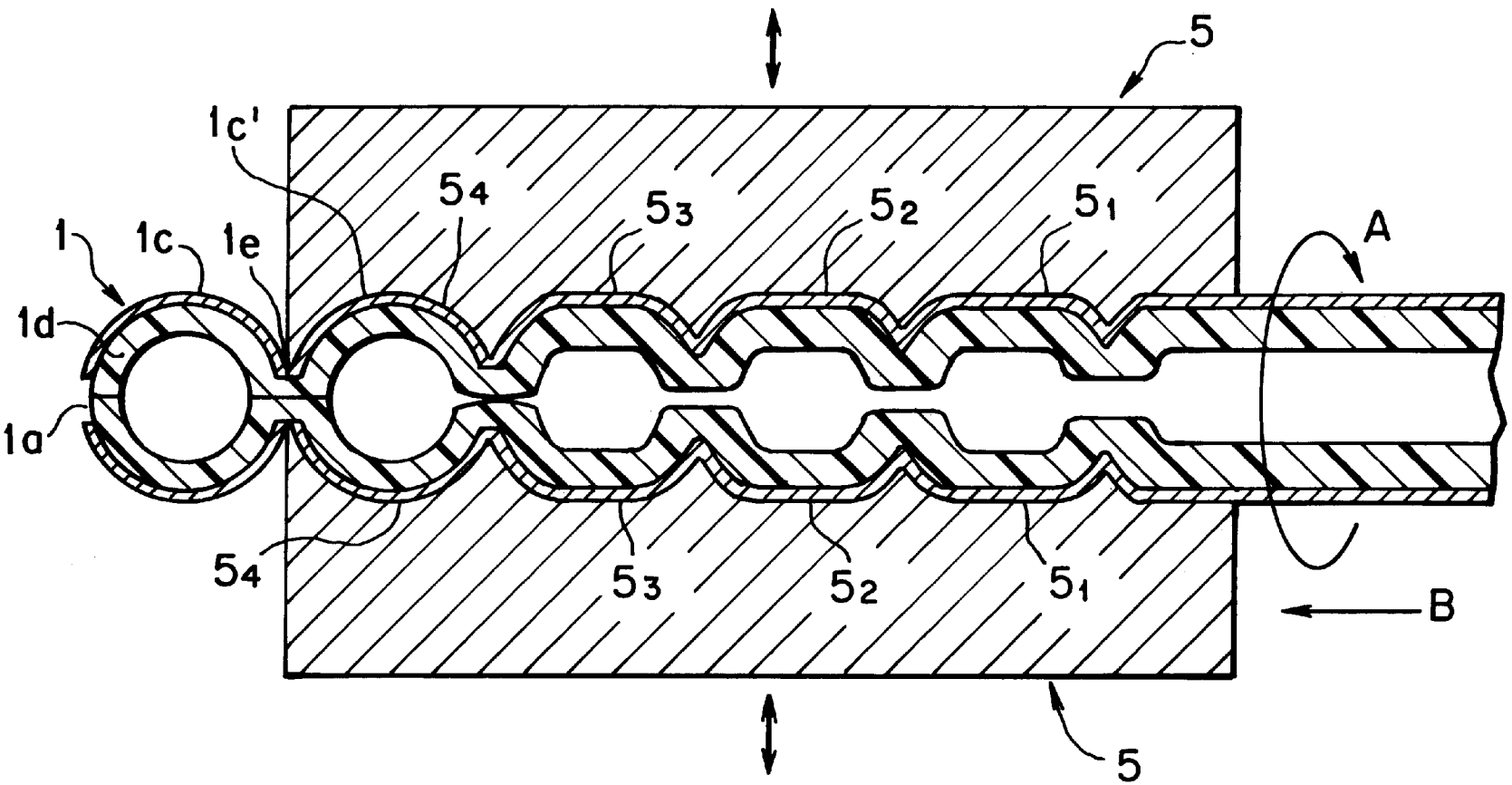
FIG. 3 is a view depicting a production of the decorated adjuster for a necklace or choker, according to the present invention.

In a second step, as shown in FIG. 3, the raw material 4 is rotated at predetermined time intervals. At the same time, the raw material 4 intermittently travels into a pair of molds 5 along an axis in the direction indicated by the arrow B. The raw material 4 travels by pitch equaling the diametrical length of the decorated adjuster for a necklace or choker.

In a third step, the raw material 4 is intermittently pressed by the molds 5 having a plurality of an adjoining concave surfaces $\mathbf{5}_1$, $\mathbf{5}_2$, $\mathbf{5}_3$ and $\mathbf{5}_4$ on an inner surface thereof.

As above described, clearances from the elastic tube 3 to the metal pipe 2 are maintained. It will be understood that when the material 4 is pressed by a pair of molds 5, slippage between the metal pipe 2 and the elastic tube 3 is not caused. As the material 4 is heated in the pressing, the elastic tube 3 will be deposited over the metal pipe 2. Thereby, the metal pipe 2 and the elastic tube 3 are integrated into a single structural member.

The concave surfaces $\mathbf{5}_1$, $\mathbf{5}_2$, $\mathbf{5}_3$ and $\mathbf{5}_4$ of the molds 5 have a shape such that an original shape of a half shell element 1*c*′ of a shell element 1*c* progressively appears from a rear end to a front end in the direction of the traveling of the raw material 4. Furthermore, the concave surfaces $\mathbf{5}_1$, $\mathbf{5}_2$, $\mathbf{5}_3$ and $\mathbf{5}_4$ of the molds 5 are formed in a shape such that a half shell element 1*c*′ in the shell element 1*c* is partially fit therein in face to face relation. Therefore, an elastic material 3 is coated as an elastic element in a thin uniform layer over the inner surface of a shell element 1*c* in the decorated adjuster 1. Furthermore, the plurality of shell element 1*c* in the decorated adjuster 1 can be produced in the connected form.

In a fourth step, the connected shell elements 1*c* in the decorated adjuster 1 are cut off by a cutter such as scissors.

The description will now be made in relation to a second process for producing the decorated adjuster for a necklace or choker. The process provides for the production of a plurality of shell elements at once.

According to the second process, in a first step, an elastic tube 3 made of a material such as silicon, natural rubber, and soft plastic is fit into a metal pipe 2 made of precious metal such as metal, silver, and platinum, as shown in FIG. 2. The metal pipe 2 is molded of metal plate in a rolling up process. When the elastic tube 3 is mounted in the metal pipe 2, clearances from the elastic tube 3 to the metal pipe 2 are maintained. Thus, a raw material 4 is produced.

Figure 4:
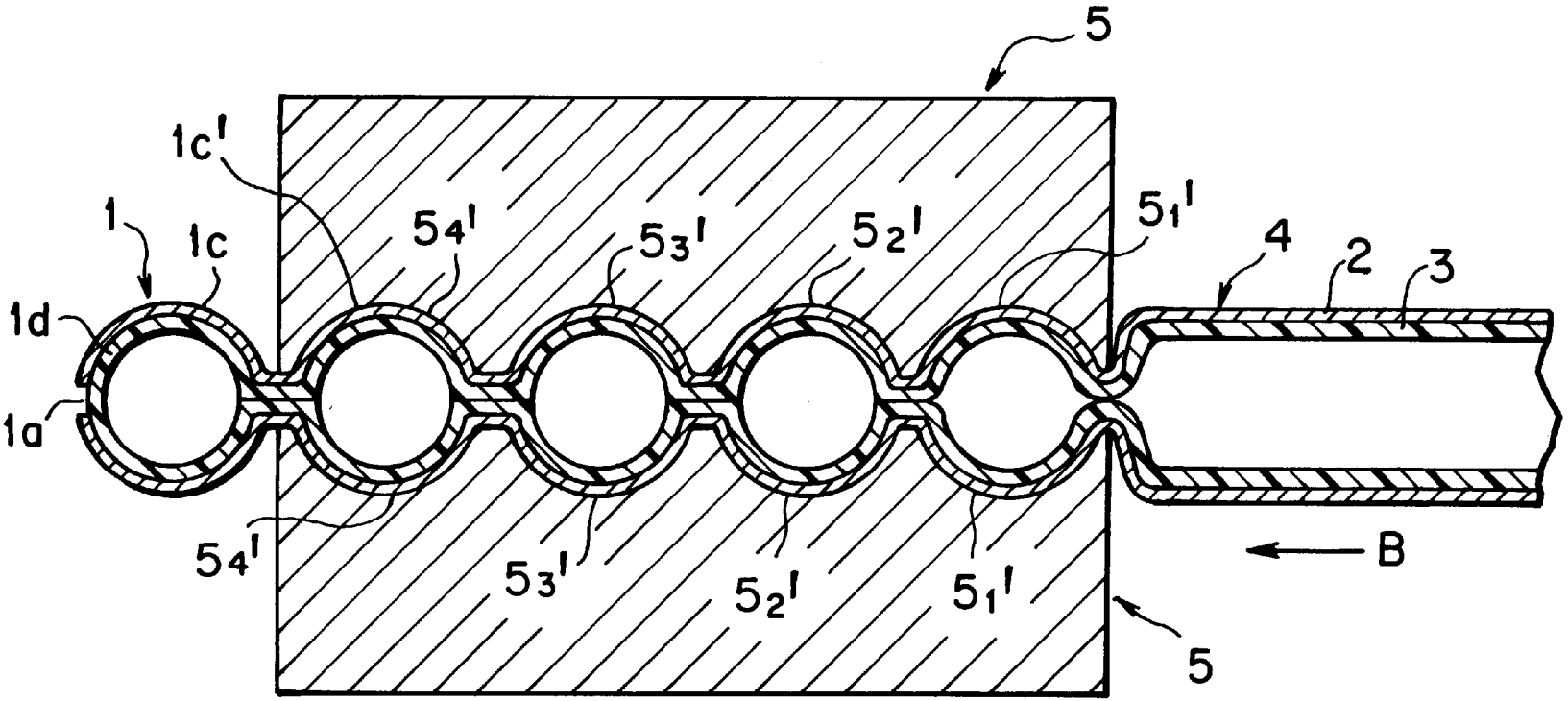
FIG. 4 is a cross-sectional view illustrating a raw material used with a production of the decorated adjuster for a necklace or choker, according to the present invention.

In a second step, as shown in FIG. 4, the raw material 4 is intermittently moved into a pair of molds 5 along an axis in the direction indicated by the arrow B. The raw material 4 travels by pitch equaling the diametrical length of the shell element in the decorated adjuster for a necklace or choker.

In a third step, the raw material 4 is intermittently pressed by the molds 5 having a plurality of the concave surfaces $\mathbf{5}_1$, $\mathbf{5}_2$, $\mathbf{5}_3$ and $\mathbf{5}_4$ formed at equally spaced intervals on an inner surface thereof.

As above described, clearances from the elastic tube 3 to the metal pipe 2 are maintained. It will be understood that when the material 4 is pressed by a pair of molds 5, slippage between the metal pipe 2 and the elastic tube 3 is not caused. As the material 4 is heated in the pressing, the elastic tube 3 will be deposited over the metal pipe 2. Thereby, the metal pipe 2 and the elastic tube 3 are integrated into a single structural member.

The concave surfaces $\mathbf{5}_1$, $\mathbf{5}_2$, $\mathbf{5}_3$ and $\mathbf{5}_4$ of the molds 5 have the same shape as a profile of a half shell element 1*c*′ in the shell element 1*c*, in face to face relation to each other, respectively. Furthermore, the molds 5 have semi-cylindrical concave surfaces formed between the concave surfaces which have the same shape as the profile of the shell element. The depth of the half cylindrical concave surfaces is higher than that of the concave surfaces with the same shape. Therefore, an elastic material 3 is coated in a thin uniform layer over the inner surface of a shell element 1*c* in the decorated adjuster 1. Furthermore, the plurality of the shell element 1*c* in the decorated adjuster 1 can be produced in the connected form.

In a fourth step, the connected shell elements 1*c* in the decorated adjuster 1 are cut off by a cutter such as scissors.

According to FIGS. 3 and 4, it was understood that only four shell elements were produced from the raw material 4 pressed by the pair of molds 5. However, it is observed in the third and fourth process for production that the number of the shell element is not limited to four. It is apparent that the number of the produced shell element depends on the number of the concave surface of the pair of molds 5. For example, if the pair of molds 5 has the concave surface $\mathbf{5}_1$', $\mathbf{5}_2$', $\mathbf{5}_3$', $\mathbf{5}_4$', $\mathbf{5}_5$', $\mathbf{5}_6$', and $\mathbf{5}_7$', respectively, then, seven shell elements will be produced.

In the illustrated embodiments, the machines for intermittently rotating the raw material 4, as indicated by the arrow A, and axially moving the raw material 4 at the predetermined intervals, were not disclosed, since these types of applied machines are well-known in the art.

Figure 5:
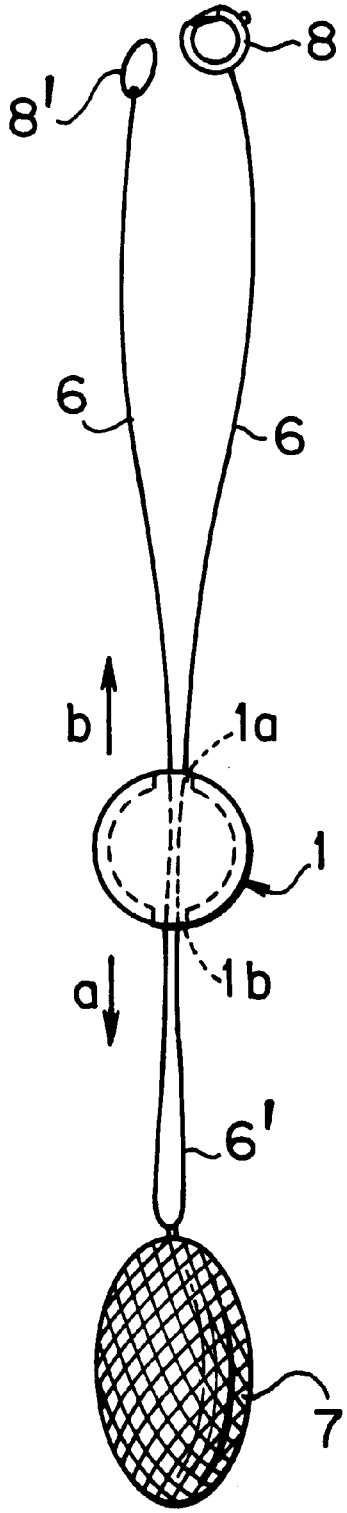
FIG. 5 is a view illustrating the necklace or choker mounting the decorated adjuster according to the present invention.
Figure 6A:
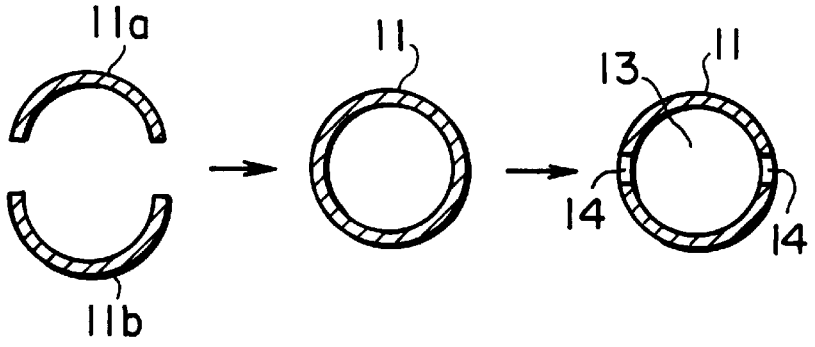
FIG. 6A PRIOR ART
FIGS. 6A–6D are views depicting a production of the conventional decorated adjuster for a necklace or choker.
Figure 6B:
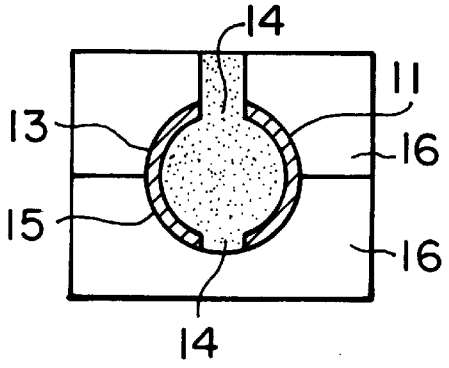
FIG. 6B PRIOR ART
Figure 6C:
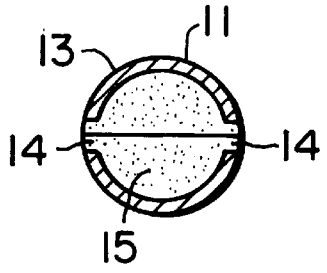
FIG. 6C PRIOR ART
Figure 6D:
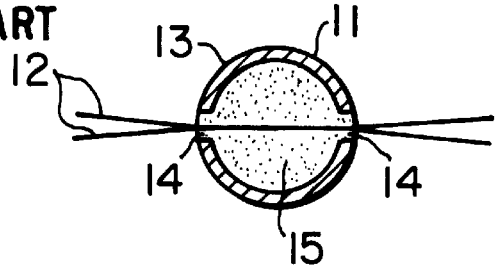
FIG. 6D PRIOR ART

As illustrated in FIG. 1, the produced shell elements 1*c* each have through apertures 1*a*, 1*b* formed on opposite sides thereof. After each of the shell elements 1*c* are produced with the elastic element 1*d* coated thereon, a small hole is pierced through the elastic element 1*c* from the through apertures 1*a*, 1*b* with needles or similar tools. Thereby, the front bent end 6' of the decorated chain 6 formed in the U-shape is inserted into the hole pierced through the elastic element 1*d* from the through aperture 1*a* to the through aperture 1*b* of the shell element 1*c* so that the decorated chain 6 passes through the shell element 1*d* in the decorated adjuster 1, until the decorated adjuster 1 is arranged at a desirable place in the decorated chain 6, as shown in FIG. 5.

As described above, the shell element 1*c* has the elastic element 1*d* provided in the inner space thereof. Accordingly, when the decorated adjuster 1 is arranged at a position on the decorated chain 6, it is movably fixed at the position through the elastic element by virtue of the ability of the elastic element to grasp the decorated chain 6 yet enable movement of the decorated adjuster 1 upon pulling of the decorated adjuster 1 relative to the decorated chain 6.

After the decorated adjuster 1 is arranged at a desirable place of the decorated chain 6, a pendant part 7 is mounted to the front end 6' of the decorated chain forming the U-shaped portion. It will be understood that the decorated chain 6 has coupling rings 8 mounted at both rear ends thereof, respectively.

The effect of the invention is evident from the above description. The decorated adjuster for necklace or choker according to the present invention enables the easy piercing of the elastic element from the through apertures provided in the precious metal-made shell element in face to face relation to one another, with needles, similar tools or a wire, as the through apertures of the shell element have a diameter which is slightly larger than the width in the front end of the decorated chain forming the U-shape, and arranged in the surface of the shell element in face to face relation to one another, and the elastic element comprises the elastic material such as silicon rubber, natural rubber, and soft plastic.

Furthermore, it will be evident that the decorated adjuster for necklace or choker according to the present invention provides much easier process and the reduced cost for production.

Moreover, it is noted that the shell element 1 may be utilized for jewelry such as a ring, earrings, or pierced earrings and so on, in which a chain is inserted and passed through a hole of the shell element, as described in the prior art. Accordingly, it should be understood that the necklace or choker was described only as an example of jewelry.

What is claimed is:

1. A method for producing a decorated adjuster for a necklace or choker, comprising the steps of:

a. producing a raw material comprising a precious metal pipe and a tube of elastic material arranged in said precious metal pipe;

b. intermittently moving said raw material along a longitudinal axis, while intermittently rotating the raw material;

c. pressing the moving and rotating raw material between a pair of molds, each of the molds having a plurality of adjoining concavities for molding the raw material, the concavities being arranged in series along the axis and formed between the distal and proximal ends of the respective molds, the concavities having a shape gradually approaching a hemispherical form in a direction from the proximal end to the distal end whereby a last one of said concavities in said molds has a hemispherical form such that the raw material is progressively formed into a shell element upon the progressive movement of the raw material, the obtained shell elements each having an inner surface coated with said elastic material and being formed consecutively upon the continual movement of the raw material through the molds; and d. cutting off the consecutive shell element, said cut-off shell elements each having a pair of through apertures bored through the shell element in face to face relation to thereby form the decorated adjuster, the through apertures being slightly larger than the width in a front end of a chain in which a U-shape is formed, when the chain is inserted into the through aperture.

2. The method for producing a decorated adjuster for a necklace or choker of claim 1, wherein said decorated adjuster includes an ornament.

3. The method for producing a decorated adjuster for a necklace or choker of claim 1, further comprising the step of selecting the elastic material from the group consisting of silicon, natural rubber and soft plastic.

4. The method for producing a decorated adjuster for a necklace or choker of claim 1, further comprising the step of selecting the precious metal from the group consisting of silver and platinum.

5. The method for producing a decorated adjuster for a necklace or choker of claim 1, further comprising the step of maintaining a clearance between the tube of elastic material and the metal pipe during the production of the raw material.

6. The method for producing a decorated adjuster for a necklace or choker of claim 1, wherein the raw material is moved by a pitch equaling the diameter of the decorated adjuster.

7. A method for producing an decorated adjuster for a necklace or choker, comprising the steps of:

a. producing a raw material comprising a precious metal pipe and a tube of elastic material arranged in said precious metal pipe;

b. intermittently moving the raw material along a longitudinal axis;

c. pressing the moving raw material between a pair of molds, each of the molds having a plurality of concavities for molding the raw material, the concavities having the same shape as a profile of a shell element in said decorated adjuster, the obtained shell elements each having an inner surface coated with said elastic material and being formed consecutively upon the continual movement of the raw material through the molds; and d. cutting off the consecutive shell element, said cut-off shell elements each having a pair of through apertures bored and arranged at a place in said shell element in face to face relation to one another to thereby form the decorated adjuster, the through apertures being slightly larger than the width in a front end of a decorated chain in which a U-shape is formed, when the decorated chain is inserted into the through aperture.

8. The method for producing a decorated adjuster for a necklace or choker of claim 7, wherein said decorated adjuster includes an ornament.

9. The method for producing a decorated adjuster for a necklace or choker of claim 7, further comprising the step of providing each of the molds with semi-cylindrical surfaces between adjacent ones of the concavities.

10. The method for producing a decorated adjuster for a necklace or choker of claim 9, further comprising the step of providing the semi-cylindrical surfaces with a higher depth than that of the concavities.

11. The method for producing a decorated adjuster for a necklace or choker of claim 7, further comprising the step of selecting the elastic material from the group consisting of silicon, natural rubber and soft plastic.

12. The method for producing a decorated adjuster for a necklace or choker of claim 7, further comprising the step of selecting the precious metal from the group consisting of silver and platinum.

13. The method for producing a decorated adjuster for a necklace or choker of claim 7, further comprising the step of maintaining a clearance between the tube of elastic material and the metal pipe during the production of the raw material.

14. The method for producing a decorated adjuster for a necklace or choker of claim 7, wherein the raw material is moved by a pitch equaling the diameter of the decorated adjuster.

15. A method for producing a decorated adjuster for a necklace or choker, comprising the steps of:

inserting a tube of elastic material into a metal pipe to thereby form a raw material;

intermittently moving the raw material along a longitudinal axis while intermittently rotating the raw material;

pressing the moving and rotating raw material between a pair of molds having a series of adjoining concavities formed between ends of the mold and which are in opposed relation to concavities in the other mold, the concavities having a shape gradually approaching a hemispherical form in a direction from an entry end to an exit end whereby a last one of the concavities in the molds has a hemispherical form such that the raw material is progressively formed into a shell element upon the progressive movement of the raw material, the shell elements obtained at the exit end of the molds each having an inner surface coated with the elastic material and being formed consecutively upon the continual movement of the raw material through the molds;

separating the shell elements from one another; and forming a pair of opposed through apertures in the shell elements to thereby form a decorated adjuster.

16. The method for producing a decorated adjuster for a necklace or choker of claim 15, further comprising the step of selecting the elastic material from the group consisting of silicon, natural rubber and soft plastic.

17. The method for producing a decorated adjuster for a necklace or choker of claim 15, further comprising the step of selecting the precious metal from the group consisting of silver and platinum.

18. The method for producing a decorated adjuster for a necklace or choker of claim 15, further comprising the step of maintaining a clearance between the tube of elastic material and the metal pipe during the formation of the raw material.

19. The method for producing a decorated adjuster for a necklace or choker of claim 15, wherein the raw material is moved by a pitch equaling the diameter of the decorated adjuster.

20. A method for producing an decorated adjuster for a necklace or choker, comprising the steps of:

inserting a tube of elastic material into a metal pipe to thereby form a raw material;

intermittently moving the raw material along a longitudinal axis;

pressing the moving raw material between a pair of molds having a series of identical, adjoining concavities formed between ends of the mold and which are in opposed relation to concavities in the other mold, the concavities having the same shape as a profile of a shell element such that the shell elements obtained at an exit end of the molds each have an inner surface coated with the elastic material and being formed consecutively upon the continual movement of the raw material through the molds;

separating the shell elements from one another; and forming a pair of opposed through apertures in the shell elements to thereby form a decorated adjuster.

21. The method for producing a decorated adjuster for a necklace or choker of claim 20, further comprising the step of providing each of the molds with semi-cylindrical surfaces between adjacent ones of the concavities.

22. The method for producing a decorated adjuster for a necklace or choker of claim 21, further comprising the step of providing the semi-cylindrical surfaces with a higher depth than that of the concavities.

23. The method for producing a decorated adjuster for a necklace or choker of claim 20, further comprising the step of selecting the elastic material from the group consisting of silicon, natural rubber and soft plastic.

24. The method for producing a decorated adjuster for a necklace or choker of claim 20, further comprising the step of selecting the precious metal from the group consisting of silver and platinum.

25. The method for producing a decorated adjuster for a necklace or choker of claim 20, further comprising the step of maintaining a clearance between the tube of elastic material and the metal pipe during the formation of the raw material.

26. The method for producing a decorated adjuster for a necklace or choker of claim 20, wherein the raw material is moved by a pitch equaling the diameter of the decorated adjuster.

* * * * *